US006581551B1

(12) United States Patent
Denbratt

(10) Patent No.: US 6,581,551 B1
(45) Date of Patent: Jun. 24, 2003

(54) METHOD OF CONTROLLING THE PROCESS OF COMBUSTION IN AN INTERNAL COMBUSTION ENGINE, AND ENGINE WITH MEANS FOR VARYING THE EFFECTIVE COMPRESSION RATIO OF THE CYLINDERS

(75) Inventor: Ingemar Denbratt, Kullavik (SE)

(73) Assignee: AB Volvo, Gothenburg (SE)

( * ) Notice: Subject to any disclaimer, the term of this patent is extended or adjusted under 35 U.S.C. 154(b) by 0 days.

(21) Appl. No.: 09/830,315

(22) PCT Filed: Oct. 26, 1999

(86) PCT No.: PCT/SE99/01929

§ 371 (c)(1),
(2), (4) Date: Jul. 30, 2001

(87) PCT Pub. No.: WO00/28198

PCT Pub. Date: May 18, 2000

(30) Foreign Application Priority Data

Oct. 26, 1998 (SE) ..... 9803666

(51) Int. Cl.[7] ..... F02B 75/04
(52) U.S. Cl. ..... 123/48 A; 123/78 A

(58) Field of Search ..... 123/48 A, 48 D, 123/48 AA, 78 D

(56) References Cited

U.S. PATENT DOCUMENTS

| | | | | |
|---|---|---|---|---|
| 4,768,481 A | | 9/1988 | Wood | |
| 5,476,072 A | | 12/1995 | Guy | |
| 6,276,334 B1 | * | 8/2001 | Flynn et al. | 123/435 |
| 6,286,482 B1 | * | 9/2001 | Flynn et al. | 123/435 |

FOREIGN PATENT DOCUMENTS

| | | |
|---|---|---|
| EP | 0 879 955 | 11/1998 |
| WO | WO 98/10179 | 3/1998 |

* cited by examiner

*Primary Examiner*—Noah P. Kamen
(74) *Attorney, Agent, or Firm*—Young & Thompson

(57) ABSTRACT

A four-stroke internal combustion engine includes variable geometric compression ratio, electrically operated inlet valves and a device for supplying a homogeneous fuel/air mixture to the engine cylinders. The inlet valves and the compression ratio are controlled by a control unit, so that the fuel/air mixture, within a lower engine rpm range, is compressed to self-ignition.

16 Claims, 1 Drawing Sheet

METHOD OF CONTROLLING THE PROCESS OF COMBUSTION IN AN INTERNAL COMBUSTION ENGINE, AND ENGINE WITH MEANS FOR VARYING THE EFFECTIVE COMPRESSION RATIO OF THE CYLINDERS

BACKGROUND OF THE INVENTION

The present invention relates to a method of controlling the combustion process in a combustion chamber in an internal combustion engine with at least one cylinder having at least one inlet valve and one exhaust valve, means for varying the geometric compression ratio of the cylinder and means for supplying a homogeneous fuel/air mixture to the combustion chamber.

The invention also relates to a four-stroke internal combustion engine with at least one cylinder having at least one inlet valve and one exhaust valve, means for varying the geometric compression ratio of the cylinder as well as means for supplying a homogeneous fuel/air mixture to the combustion chamber of the cylinder.

For homogeneous charge compression ignition (HCCI) in a four-stroke internal combustion engine, a homogeneous diluted (with extra air or residual gas) fuel/air mixture is compressed to self-ignition. The advantage of this compared to first compressing the inlet air and then injecting fuel into the combustion chamber (the diesel process) is that the entire fuel/air mixture bums simultaneously and not successively as when a flame front propagates through the combustion chamber from a sparkplug or injector. This creates a homogeneous temperature in the combustion chamber, which in turn makes it possible to achieve, for example in an unthrottled Otto-engine at partial load, the efficiency of the diesel engine but without the high nitrogen oxide and particle emissions of the diesel engine. The nitrogen emissions can be reduced from ca. 1000 ppm to as little as 10–20 ppm. The particle emissions of the diesel engine can be reduced to the same level as those of the Otto-engine. The difficulty is, however, to control the combustion since it is kinetically controlled. If the mixture is too rich, the energy released will be too rapid (knocking), and if it is too lean, ignition will be made impossible. In an HCCI Otto-engine with gasoline as fuel, a high and controlled temperature is required to achieve self-ignition, and this can be achieved with high compression ratio and/or by heating the inlet air. In an HCCI diesel engine with diesel oil as fuel, lower temperatures are required than with a normal diesel engine, which means that the compression ratio must be lowered.

The difficulty up to now in HCCI-engines has been to control the ignition delay (the cylinder temperature) in such a manner that the combustion is positioned correctly about the top dead centre at various rpm:s and loads, and this has greatly reduced the range of use of such engines. Especially control problems during transients, where the cylinder temperature must be checked from one cycle to the next, has limited the range of use of HCCI-engines to generators, for example, where the drive unit operates with very small variations in rpm and load.

SUMMARY OF THE INVENTION

The purpose of the present invention is to achieve a method of controlling the temperature in the cylinders in an HCCI-engine, so that the ignition time will be correct at various engine speeds and loads, thereby making it practically possible to use HCCI-engines in motor vehicles, thereby reducing their fuel consumption and emissions.

This is achieved according to the invention by virtue of the fact that the compression ratio and the closing of the inlet valve are controlled so that the mixture, at least within a lower rpm range, is compressed to self-ignition.

Complete freedom of valve control, so that the opening and closing time can also be freely controlled from cycle to cycle, can be achieved by using electromagnetically operated valves. The compression ratio can be varied in a known manner by virtue of the fact that the engine cylinder communicates with an additional cylinder containing a movable plunger by means of which the total volume of the combustion chamber can be varied.

An HCCI-engine which must be able to operate within a wide rpm range, e.g. with an upper rpm limit of about 6000 rpm, is preferably equipped with an ignition system which is controlled so that it is deactivated within said lower rpm range, the upper limit of which can lie between 3000 and 4000 rpm. When this limit is exceeded, the ignition system is activated at the same time as the control of the inlet valve is changed and the compression ratio is reduced to normal engine operation.

An internal combustion engine of the type described by way of introduction, which is to be controlled in the manner described above, is characterized in that at least the inlet valve has variable valve times and that the control means are arranged to control the degree of opening of the inlet valve and the compression ratio of the cylinder as a function of engine speed and load, so that the mixture, at least within a lower engine speed range, is compressed to self-ignition.

BRIEF DESCRIPTION OF THE DRAWINGS

The method according to the invention will be described below with reference to the accompanying drawings, where.

DETAILED DESCRIPTION OF THE PREFERRED EMBODIMENTS

Figure 1:
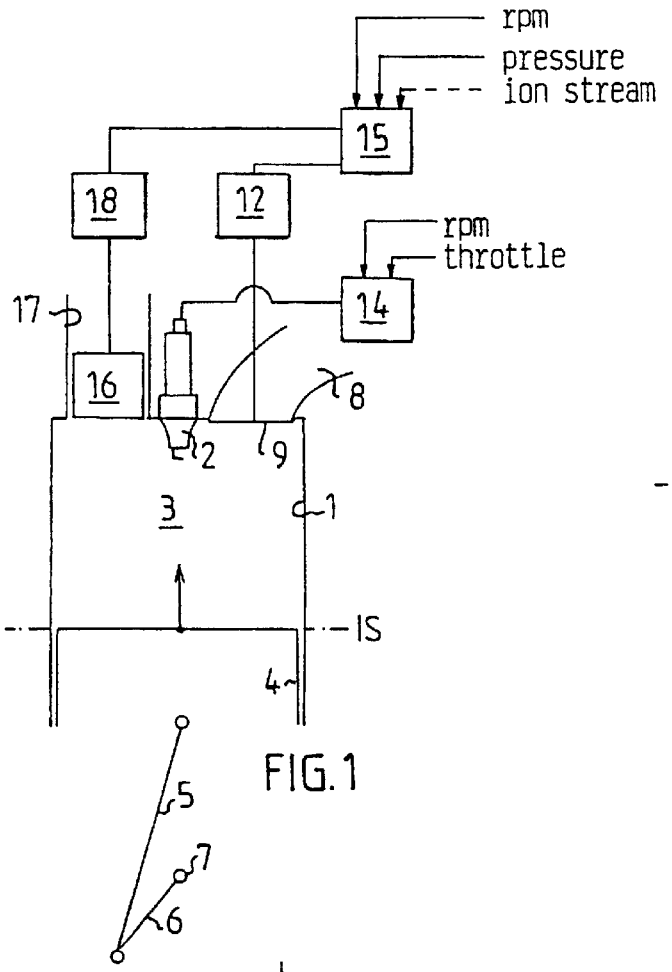
FIGS. 1–4 show schematically a cylinder with associated piston in a four-stroke internal combustion engine with variable compression ratio.
Figure 2:
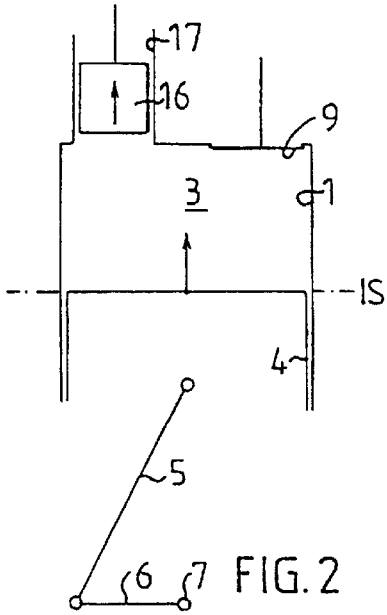

In FIG. 1, 1 designates a cylinder in the engine block of a four-stroke internal combustion engine, which in the example shown is an Otto-engine, having a sparkplug 2 projecting into the combustion chamber 3. The cylinder 1 has a piston 4, which is connected via a connecting rod 5 to a throw 6 on the crankshaft 7. The combustion chamber 3 has an inlet 8 for supply of fuel/air mixture. An inlet valve 9 is arranged in the inlet port of the combustion chamber. An exhaust valve (not shown) is arranged in an outlet port to the exhaust conduit.

The opening and closing of the inlet valve 9 is electromagnetically controlled with the aid of an electromagnetic device 12. The valve can be of a type which is known per se with a valve spindle joined to a metal disc located between two electromagnets. The electromagnets are magnetized alternatingly and the metal disc is drawn towards that magnet which is momentarily magnetized. With electromagnetically controlled valves of this known type, the degree of opening of the valves can be freely controlled, both from cycle to cycle and for individual cylinders. The sparkplug 2 is joined to an ignition system 14 with a control unit into which, for example, signals representing engine rpm and accelerator pedal position are fed for controlling the ignition as a function of engine rpm and load. The electromagnets of the valve 9 are controlled by a control unit 15 into which there is fed a signal from a sensor (not shown), which directly or indirectly measures the pressure P in the cylinder chamber, and/or a signal representing the ion flow. This signal can be obtained with the sparkplug as a sensor.

The control unit 15 also controls the compression ratio in the cylinder 1 by regulating the position of a plunger 16 in a cylinder 17 communicating with the cylinder 1. The position of the plunger 16 in the cylinder is controlled by operating means 18, which, for example, can be of the type shown and described in SE-A-405 993.

Figure 3:
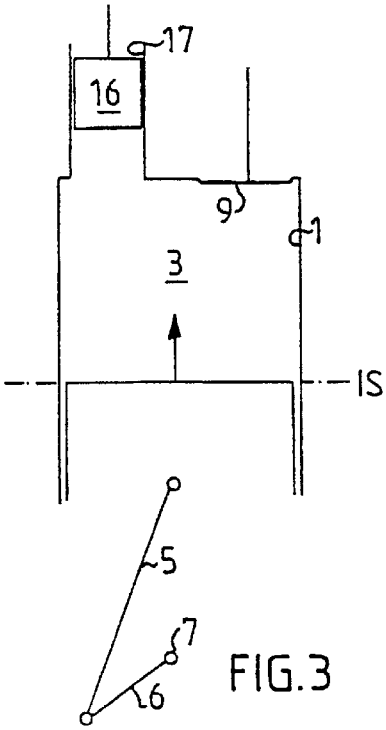
Figure 4:
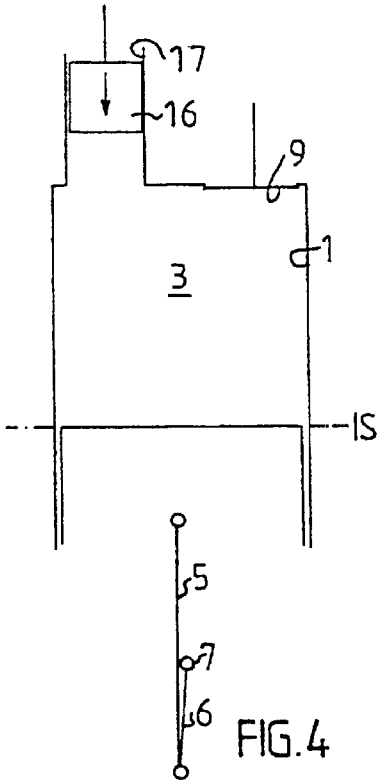

FIGS. 1–4 show HCCI-operation, i.e. the ignition system is deactivated and ignition of the fuel/air mixture supplied to the combustion chamber 3 is effected by self-ignition during compression of the mixture. FIG. 1 illustrates the position of the plunger 16 at maximum compression ratio and the position IS of the piston 4, when the inlet valve 9 closes during the compression stroke at low load and high rpm within the low rpm range (i.e. up to ca. 3000–4000 rpm). During a transient state to higher load and lower rpm from the operating state in FIG. 1, the effective compression ratio is reduced, firstly, by pulling the plunger 16 back, as indicated by the arrow in FIG. 2, so that the geometric compression ratio is reduced, and, secondly, by delaying the closing of the inlet valve 9. In FIG. 3, the position IS of the piston 4 is illustrated when the inlet valve 9 closes at higher load and lower rpm. As a comparison will show, the closing time is approximately the same as for the state in FIG. 1. The compression ratio, however, has been lowered by the plunger 16 being pulled back to increase the total volume of the combustion chamber. During a transient to lower load and higher rpm (FIG. 4) from the operating state in FIG. 3, the effective compression ratio is increased, firstly, by moving the plunger 16 forward, as indicated by the arrow on the plunger 16, so that the geometric compression ratio increases, and, secondly, by closing the inlet valve 9 earlier. In FIG. 4, the inlet valve 9 closes at the bottom dead centre of the piston 4.

When the rpm exceeds the upper limit of the lower rpm range, e.g. at ca. 4000 rpm, for a passenger car with a top end rpm of ca. 6000–8000 rpm, the control is switched to normal Otto-engine operation, i.e. with a normal compression ratio and valve overlap, at the same time as the ignition system is activated. This switch also occurs when the engine load exceeds 50–70% of the maximum engine load. A "normal" compression ratio can be ca. 8–10:1 and the maximum compression ratio under HCCI-operation is ca. 16–20:1.

The effective compression ratio can be regulated by varying the geometric compression ratio or by varying the point in time when the inlet valve closes, or by a combination of these two. The exhaust valve (not shown) can be electromagnetically operated as is the inlet valve, but since the control during HCCI-operation does not require variable valve timing for the exhaust valve, it can be camshaft-controlled in a conventional manner.

What is claimed is:

1. Method of controlling the combustion process in the combustion chamber of a four-stroke internal combustion engine with at least one cylinder having at least one inlet valve and one exhaust valve, means for varying the geometric compression ratio of the cylinder, and means for supplying a homogeneous fuel/air mixture to the combustion chamber, wherein the compression ratio and the closing of the inlet valve are controlled so that the mixture, at least within a lower rpm range, is compressed to self-ignition, and wherein the combustion ratio and the closing of the inlet valve are controlled so that the compression ratio will be higher and the valve close earlier at low loads and high engine speed than at high loads and low engine speed, that the compression ratio is reduced and the closing of the valve is set later intransient states to high load and low engine speed, and that the compression ratio is raised and the valve is closed earlier in transient states to low load and high engine speed.

2. Method according to claim 1 when controlling the combustion process in an internal combustion engine with means for spark ignition of the fuel/air mixture in the combustion chamber, wherein the spark ignition means are held deactivated within said lower engine speed range and are activated when the speed of the engine exceeds the upper limit of the lower engine speed range, at the same time as the geometric compression ratio is controlled towards a low level.

3. Method according to claim 1, wherein at least the inlet valve is controlled by electromagnetic means.

4. Method according to claim 1, wherein gasoline is used as fuel.

5. Method according to claim 1, wherein the geometric compression ratio and the closing of the inlet valve are controlled so that the highest effective compression ratio is approximately twice the lowest effective compression ratio.

6. Four-stroke internal combustion engine with at least one cylinder having at least one inlet valve and one exhaust valve, means for varying the geometric compression ratio of the cylinder and means for supplying a homogeneous fuel/air mixture to the combustion chamber of the cylinder, characterized in that at least the inlet valve has variable valve times and that the control means (12,15,18) are arranged to control the degree of opening of the inlet valve (9) and the compression ratio of the cylinder (1) as a function of engine speed and load, so that the mixture, at least within a lower engine speed range, is compressed to selfignition.

7. Engine according to claim 6, characterized in that the control means (12,15,18) are arranged to control the compression ratio and the closing of the inlet valve (9), so that the compression ratio becomes higher and the valve closes earlier at low loads and high engine speed than at high loads and low engine speed, that the compression ratio is reduced and the valve closes later in transient states to high load and low engine speed, and that the compression ratio is raised and the valve closes earlier in transient states to low load and high engine speed.

8. Engine according to claim 6, characterized in that the inlet valve (9) and the means for varying the geometric compression of the cylinder (1) have operating means (12, 18), coupled to a control unit (15), which controls the operating means as a function of various control signals fed to the control unit.

9. Engine according to claim 8, characterized in that the inlet valve (9) has electromagnetic operating means (12).

10. Engine according to claim 9, characterized in that the control unit (15) is connected to an ion flow signal sensor arranged in the combustion chamber (3) and to a tachometer.

11. Engine according to claim 9, characterized in that the control unit (15) is connected to a pressure signal sensor arranged in the combustion chamber (3).

12. Engine according to claim 6 with an ignition system (2,14) comprising at least one sparkplug (2) for each cylinder and an ignition control device (14), which is connected to a tachometer and an accelerator pedal position sensor, characterized in that the ignition control device (14) is disposed to keep the sparkplug (2) deactivated within said lower engine speed range and to activate the sparkplug when the engine speed exceeds the upper limit of the lower engine speed range, and that the control unit (15) is arranged to then, firstly, control the inlet valve (9) and the exhaust valve, so that the inlet valve begins to open before the exhaust valve is completely closed, and, secondly, to control the geometric compression ratio towards a low level.

13. Engine according to claim 7, characterized in that the inlet valve (9) and the means for varying the geometric compression of the cylinder (1) have operating means (12, 18), coupled to a control unit (15), which controls the operating means as a function of various control signals fed to the control unit.

14. Engine according to claim 13, characterized in that the inlet valve (9) has electromagnetic operating means (12).

15. Engine according to claim 14, characterized in that the control unit (15) is connected to an ion flow signal sensor arranged in the combustion chamber (3) and to a tachometer.

16. Engine according to claim 14, characterized in that the control unit (15) is connected to a pressure signal sensor arranged in the combustion chamber (3).

* * * * *